US012228348B2

(12) United States Patent
Romlund

(10) Patent No.: US 12,228,348 B2
(45) Date of Patent: Feb. 18, 2025

(54) PLATE HEAT EXCHANGER, AND A METHOD OF MANUFACTURING A PLATE HEAT EXCHANGER

(71) Applicant: ALFA LAVAL CORPORATE AB, Lund (SE)

(72) Inventor: Jens Romlund, Helsingborg (SE)

(73) Assignee: ALFA LAVAL CORPORATE AB, Lund (SE)

( * ) Notice: Subject to any disclaimer, the term of this patent is extended or adjusted under 35 U.S.C. 154(b) by 491 days.

(21) Appl. No.: 17/612,730

(22) PCT Filed: May 8, 2020

(86) PCT No.: PCT/EP2020/062863
§ 371 (c)(1),
(2) Date: Nov. 19, 2021

(87) PCT Pub. No.: WO2020/234006
PCT Pub. Date: Nov. 26, 2020

(65) Prior Publication Data

US 2022/0236016 A1 Jul. 28, 2022

(30) Foreign Application Priority Data

May 21, 2019 (SE) ..... 1950601-3

(51) Int. Cl.
*F28D 9/00* (2006.01)
*F28F 3/04* (2006.01)
*F28F 9/02* (2006.01)

(52) U.S. Cl.
CPC ..... *F28D 9/005* (2013.01); *F28F 3/046* (2013.01); *F28F 9/0229* (2013.01)

(58) Field of Classification Search
CPC ..... F28D 9/005; F28F 3/046; F28F 9/0229
(Continued)

(56) References Cited

U.S. PATENT DOCUMENTS 4,063,591 A * 12/1977 Usher ..... F28F 3/083 165/167
4,987,955 A * 1/1991 Bergqvist ..... F28D 9/0075 165/906

(Continued)

FOREIGN PATENT DOCUMENTS

CN 1127548 A 7/1996
CN 1656351 A 8/2005

(Continued)

OTHER PUBLICATIONS

Wang et al., "Recent Advances of Plate-type Evaporator", Chemical Industry and Engineering Progress, S1, (Nov. 15, 2009), No. 28, pp. 343-345.

(Continued)

*Primary Examiner* — Claire E Rojohn, III
(74) *Attorney, Agent, or Firm* — BUCHANAN INGERSOLL & ROONEY PC

(57) ABSTRACT

A plate heat exchanger and a method of manufacturing a plate heat exchanger are disclosed. The plate heat exchanger comprises plurality of plates, each comprising a central area with a corrugation of ridges and valleys extending between an upper level and a lower level. Each of four porthole areas comprises an annular flat area located at the upper or lower level. The plates comprise heat exchanger plates and an end plate. Each heat exchanger plate comprises four portholes through the respective porthole area. Each porthole area of the end plate is closed by a plate portion. A number of protrusions project from the annular flat area of the end plate to one of the lower level and the upper level. The protrusions, that project to the upper level, abut the annular flat area of the adjoining heat exchanger plate.

16 Claims, 6 Drawing Sheets

(58) Field of Classification Search
USPC ..... 165/166
See application file for complete search history.

(56) References Cited

U.S. PATENT DOCUMENTS 6,394,178 B1 * 5/2002 Yoshida ..... F28F 3/046 165/DIG. 368
8,109,326 B2 * 2/2012 Larsson ..... F28F 3/046 165/166
8,181,696 B2 * 5/2012 Rassmus ..... F28D 9/005 165/906
8,393,384 B2 * 3/2013 Velte ..... F28F 9/0246 165/170
8,662,151 B2 * 3/2014 Gustafsson ..... F28D 9/005 165/167
10,035,207 B2 * 7/2018 Bornegard ..... F28F 3/086
10,697,677 B2 * 6/2020 Yanachi ..... F25B 43/00
10,724,801 B2 * 7/2020 Mohammadian ..... F28F 9/026
10,837,717 B2 * 11/2020 Andersson ..... F28F 3/02
10,852,067 B2 * 12/2020 Balasus ..... F28F 3/10
10,989,486 B2 * 4/2021 Hedberg ..... F28D 9/005
11,105,561 B2 * 8/2021 Sanchez ..... F28D 9/0037
11,156,405 B2 * 10/2021 Blomgren ..... F28F 3/10
2001/0030043 A1 * 10/2001 Gleisle ..... F28D 9/005 165/167
2003/0094271 A1 * 5/2003 Leuthner ..... F28F 9/0268 165/906
2005/0056412 A1 * 3/2005 Reinke ..... F28F 13/06 165/167
2006/0237178 A1 10/2006 Katoh et al.
2009/0008072 A1 * 1/2009 Rassmus ..... F28D 9/005 165/167
2009/0126911 A1 * 5/2009 Shore ..... F28D 1/0333 165/166
2011/0024097 A1 * 2/2011 Christensen ..... F28D 9/005 165/166
2011/0036547 A1 * 2/2011 Christensen ..... F28F 9/028 165/166
2011/0088882 A1 * 4/2011 Persson ..... F28D 9/005 29/890.039
2011/0168371 A1 * 7/2011 Gustafsson ..... F28D 9/005 165/170
2011/0290462 A1 * 12/2011 Andersson ..... F28D 9/005 165/170
2012/0118542 A1 * 5/2012 Kanzaka ..... F28F 3/025 165/148
2013/0014923 A1 1/2013 Girmscheid et al.
2013/0126135 A1 * 5/2013 Romlund ..... F28D 9/005 165/166
2013/0126137 A1 * 5/2013 Velte ..... F28D 1/0333 165/167
2013/0192291 A1 * 8/2013 Ito ..... F28D 9/0068 62/324.1
2013/0228307 A1 * 9/2013 Kanzaka ..... F28F 3/08 165/76
2014/0020866 A1 1/2014 Bluetling et al.
2014/0352934 A1 12/2014 Barone et al.
2015/0292803 A1 * 10/2015 Nyander ..... B23P 15/26 29/890.03
2016/0123676 A1 * 5/2016 Lee ..... F28D 9/005 165/166
2017/0067695 A1 3/2017 Wei et al.
2018/0252479 A1 9/2018 Kenney et al.
2019/0024983 A1 * 1/2019 Romlund ..... F28F 3/046
2019/0033003 A1 * 1/2019 Mohammadian ..... F28F 9/0075
2019/0033005 A1 * 1/2019 Romlund ..... C22C 19/056
2019/0226731 A1 * 7/2019 Mizuno ..... F28F 3/044
2019/0264985 A1 * 8/2019 Romlund ..... F28D 9/005
2021/0033358 A1 * 2/2021 Davidkov ..... C22C 21/18
2022/0099379 A1 * 3/2022 Romlund ..... F28F 9/028
2023/0061944 A1 * 3/2023 Romlund ..... F28F 3/025

FOREIGN PATENT DOCUMENTS

| | | | |
|---|---|---|---|
| CN | 1753741 | A | 3/2006 |
| CN | 101487671 | A | 7/2009 |
| CN | 101568790 | A | 10/2009 |
| CN | 101595359 | A | 12/2009 |
| CN | 101983310 | A | 3/2011 |
| CN | 103776284 | A | 5/2014 |
| CN | 103791759 | A | 5/2014 |
| CN | 104215113 | A | 12/2014 |
| CN | 108541182 | A | 9/2018 |
| CN | 109073325 | A | 12/2018 |
| CN | 208382951 | U | 1/2019 |
| EP | 1850082 | A1 | 10/2007 |
| JP | H01-503558 | A | 11/1989 |
| JP | 2005-326072 | A | 11/2005 |
| JP | 2016-080230 | A | 5/2016 |
| JP | 2016-176618 | A | 10/2016 |
| KR | 100739483 | B1 | 7/2007 |
| KR | 101897514 | B1 | 9/2018 |
| SE | 517516 | C2 | 6/2002 |
| WO | 9500810 | A1 | 1/1995 |
| WO | 9837373 | A1 | 8/1998 |
| WO | 03/091647 | A1 | 11/2003 |
| WO | 2004/076093 | A1 | 9/2004 |
| WO | 2008/058376 | A1 | 5/2008 |
| WO | 2008/071356 | A1 | 6/2008 |
| WO | 2009/123516 | A1 | 10/2009 |
| WO | 2009123518 | A1 | 10/2009 |
| WO | 2015/037688 | A1 | 3/2015 |
| WO | 2015082350 | A1 | 6/2015 |
| WO | 2015/131834 | A1 | 9/2015 |

OTHER PUBLICATIONS

Office Action (The First Office Action) issued Mar. 22, 2023, by the National Intellectual Property Administration, P. R. China in corresponding Chinese Patent Application No. 202080037325.0 and an English translation of the Office Action. (17 pages).
International Search Report (PCT/ISA/210) and Written Opinion (PCT/ISA/237) mailed on Aug. 14, 2020, by the European Patent Office as the International Searching Authority for International Application No. PCT/EP2020/062863. (11 pages).
English translation of the Office Action (Notice of Reasons for Rejection) issued Jan. 4, 2023, by the Japan Patent Office in corresponding Japanese Patent Application No. 2021-569171. (5 pages).
Yang et al., "An Experimental Study of Plate-type Air-air Heat Exchanger Thermotechnical Properties", Journal of Engineering for Thermal Energy and Power, 1991 (month unknown), vol. 2, No. 32, pp. 80-85.
Notice of Allowance (Notification to Grant Patent Right for Invention) issue Aug. 10, 2023, by the National Intellectual Property Administration, P. R. China in corresponding Chinese Patent Application No. 202080037325.0 and an English translation of the Notice. (12 pages).

* cited by examiner

PLATE HEAT EXCHANGER, AND A METHOD OF MANUFACTURING A PLATE HEAT EXCHANGER

TECHNICAL FIELD OF THE INVENTION

The present invention refers to a plate heat exchanger. The invention also refers to a method of manufacturing a plate heat exchanger.

BACKGROUND OF THE INVENTION AND PRIOR ART

In many plate heat exchanger applications, a high strength is required. This is important when the working pressure of one or both of the media conveyed through the plate heat exchanger is high or when the working pressure for one or both of the media various over time. In order to meet the requirements of a high strength, it is known to use thicker end or strengthening plates, i.e. the two plates located at the outermost position in the plate package. These strengthening plates may also be designated as adapter plates, or frame and pressure plates.

It is also known to use sheets, washers or thick plane plates as strengthening plates. Such sheets, washers or thick plane plates may also be provided outside the frame and/or pressure plates. A disadvantage of such additional plates, washers or the like is that the manufacturing becomes more complicated and thus more expensive since more components have to be attached when the plate heat exchanger is produced, for instance when it is brazed.

U.S. Pat. No. 4,987,955 discloses a plate heat exchanger comprising a plurality of plates extending in parallel with a main extension plane. The plates comprise a plurality of heat exchanger plates, two outer cover plates provided outside a respective one of the outermost heat exchanger plates, and a corrugated end plate provided between one of the outermost heat exchanger plates and one of the outer cover plates. The strengthening outer cover plates are plane and have a significantly greater thickness than the heat exchanger plates. The end plate has porthole areas that are closed.

WO 2009/123518 discloses a plate heat exchanger comprising a plurality of heat exchanger plates joined to each other. Each plate has a heat transfer area and four porthole areas. Each porthole area surrounds a porthole having a porthole edge. This prior art plate heat exchanger has a high strength. Several measures have been taken to achieve the high strength, for instance at the porthole areas of the heat exchanger plates. The heat exchanger plates are provided between a first end plate and a second end plate, which both are plane and have a significantly greater thickness than the heat exchanger plates.

A further disadvantage of thicker strengthening plates with more material is a higher thermal inertia. Due to this higher thermal inertia, the thermal fatigue performance of the plate heat exchanger is reduced, in particular in the heat exchanger plates which are provided most adjacent to and inside the strengthening plates. Since the heat exchanger plates are manufactured of a thinner material, they will more rapidly be adapted to the temperature of the media, which results in an undesired temperature difference between the heat exchanger plates and the strengthening plates, and thus to thermally dependent stresses.

Still further, thicker strengthening plates result in the disadvantage that the consumption of material becomes larger and thus the costs for the plate heat exchanger increase.

US-B1-8,181,696 discloses a plate heat exchanger comprising a plurality of plates. The plates extend in parallel to a main extension plane and comprise several heat exchanger plates and two strengthening end plates. The heat exchanger plates are provided beside each other and form a plate package with first plate interspaces and second plate interspaces. Each heat exchanger plate has four portholes forming ports through the plate package. The heat exchanger plates comprise an outermost heat exchanger plate at one side of the plate package and an outermost heat exchanger plate at an opposite side of the plate package. Two of said plate interspaces in the plate package form a respective outermost plate interspace at a respective side of the plate package, which are delimited outwardly by a respective one of the outermost heat exchanger plates. The strengthening end plates are provided outside a respective one of the outermost heat exchanger plates.

SUMMARY OF THE INVENTION

The purpose of the present invention is to remedy the disadvantages mentioned above and to provide a plate heat exchanger with a high strength. In particular, it is aimed at an improved strength in the porthole area of the closed end plate.

The purpose is achieved by the plate heat exchanger initially defined, which is characterized in that each porthole of the heat exchanger plates is defined by a porthole edge formed by the annular flat area, each of the porthole areas of the first end plate comprises a number of protrusions arranged on and projecting from the annular flat area to one of the lower level and the upper level, and each of the protrusions of the first end plate, that projects to the upper level, abuts the annular flat area of the adjoining outermost heat exchanger plate.

The first end plate having closed porthole areas may have a higher strength than the heat exchanger plates in particular in and at the porthole areas thanks to the provision of the protrusions projecting from the annular flat area. Since the protrusions adjoin the annular flat area of the adjoining heat exchanger plate, a rigid support may be created for the porthole area of the first end plate, and even for the porthole areas of all plates of the plate packages.

Such a first end plate may in many plate heat exchanger applications replace the plane thicker cover plates, which are more expensive and render the plate heat exchanger significantly heavier.

The annular flat area of the heat exchanger plates may adjoin an annular flat area of an adjoining heat exchanger plate, and thus the annular flat areas function as a sealing for closing a plate interspace formed between these two adjacent heat exchanger plates.

The heat exchanger plates may be arranged in the plate package to form first plate interspaces for a first fluid and second plate interspaces for a second fluid. The first and second plate interspaces may be arranged in an alternating order in the plate package. The heat exchanger plates may be identical, but every second heat exchanger plate may be rotated 180° in the extension plane.

According to an embodiment of the invention, each of the protrusions of the first end plate that projects to the upper level is joined to the annular flat area of the adjoining outermost heat exchanger plate. Through such a joining the strength is further enhanced.

According to an embodiment of the invention, the protrusions project to the lower level when the annular flat area is located at the upper level, and to upper level when the annular flat area is located at the lower level.

According to an embodiment of the invention, the plates also comprise a second end plate provided outside and adjoining the first end plate in the plate package, wherein each of the porthole areas of the second end plate is closed by means of a plate portion surrounded by the annular flat area, each of the porthole areas of the second end plate comprises a number of protrusions arranged on and projecting from the annular flat area to one of the lower level and the upper level, and each of the protrusions of the second end plate, that projects to the upper level, abuts a respective one of the protrusions of the annular flat area of the adjoining first end plate.

Such a second end plate provided outside the first end plate, may improve the strength even further, in particular in and at the porthole areas.

According to an embodiment of the invention, each of the protrusions of the second end plate that projects to the upper level is joined to a respective one of the protrusions of annular flat area of the adjoining first end plate. Through such a joining the strength is further enhanced.

According to an embodiment of the invention, the plate portion that is surrounded by the annular flat area is circular and comprises a strengthening area at the lower level when the annular flat area is located at the upper level, and at upper level when the annular flat area is located at the lower level. Such a projection of the strengthening area of the plate portion in relation to the annular flat area may strengthen the porthole area.

According to an embodiment of the invention, the protrusions extend to the plate portion. The protrusions may thus be shaped as beams extending towards and to the plate portion. The protrusions may thus adjoin the plate portion.

According to an embodiment of the invention, the protrusions extend across the annular flat area. For instance, the protrusions may extend across the whole width of the annular flat area.

According to an embodiment of the invention, the protrusions are located on the annular flat area at a distance from the plate portion.

According to an embodiment of the invention, the annular flat area adjoins the plate portion. For instance, the annular flat area may adjoin the plate portion along the whole inner circumference of the annular flat area.

According to an embodiment of the invention, the strengthening area has a flat extension at one of the upper level and the lower level.

According to an embodiment of the invention, the strengthening area is annular. Such an annular shape of the strengthening area may further improve the strength of the plate portion.

According to an embodiment of the invention, the protrusions have a flat extension at the upper level and the lower level, respectively. The flat extension of the protrusion may ensure a relatively large contact area against the annular flat area of the adjacent heat exchanger plate, or against the respective protrusion of the adjacent first or second end plate.

The purpose is also achieved by the method initially defined, which is characterized by the following steps:

selecting at least a first end plate and heat exchanger plates from said plurality of plates, cutting four portholes through a respective one of the porthole areas of each of the heat exchanger plates, wherein each porthole is defined by a porthole edge formed by the annular flat area, and pressing a number of protrusions in a second pressing operation to project from the annular flat area to one of the lower level and the upper level on each of the porthole areas of the first end plate.

According to a variant of the invention, the method may comprise the step of:

assembling and joining the heat exchanger plates and the first end plate to obtain a plate package having four porthole channels extending through the respective portholes of the heat exchanger plates and being closed by the first end plate. Each of the protrusions of the first end plate, that project to the upper level, may abut the annular flat area of the adjoining outermost heat exchanger plate.

According to a variant of the invention, the selecting steps in addition to the selection of the first end plate and the heat exchanger plates also comprises selecting a second end plate, wherein the method also comprises the step of:

pressing a number of protrusions to project from the annular flat area to one of the lower level and the upper level on each of the porthole areas of second end plate.

According to a variant of the invention, the method may comprise the further the step of:

assembling and joining the heat exchanger plates, the first end plate and the second end plate to obtain a plate package having four porthole channels extending through the respective portholes of the heat exchanger plates and being closed by the first end plate and the second end plate. Each of the protrusions of the second end plate, that project to the upper level, may abut a respective one of the protrusions of the annular flat area of the adjoining first end plate.

BRIEF DESCRIPTION OF THE DRAWINGS

The present invention is now to be explained more closely through a description of various embodiments and with reference to the drawings attached hereto.

DETAILED DESCRIPTION OF VARIOUS EMBODIMENTS

Figure 1:
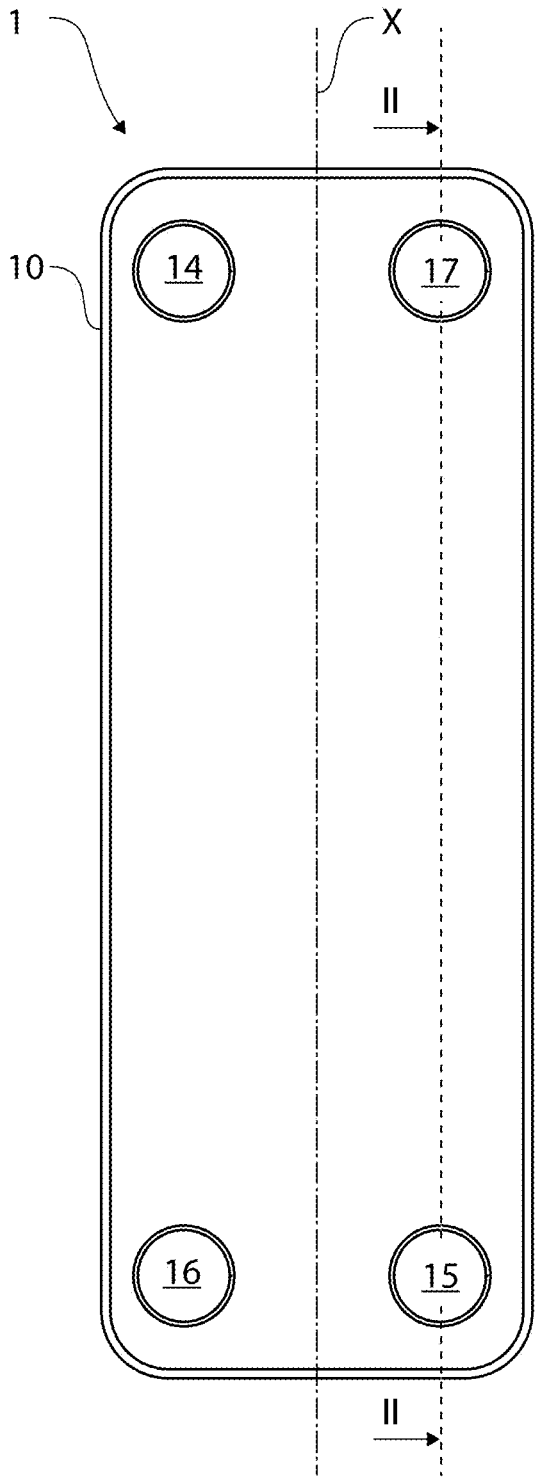
FIG. 1 discloses schematically a plan view of a plate heat exchanger according to a first embodiment of the invention.
Figure 2:
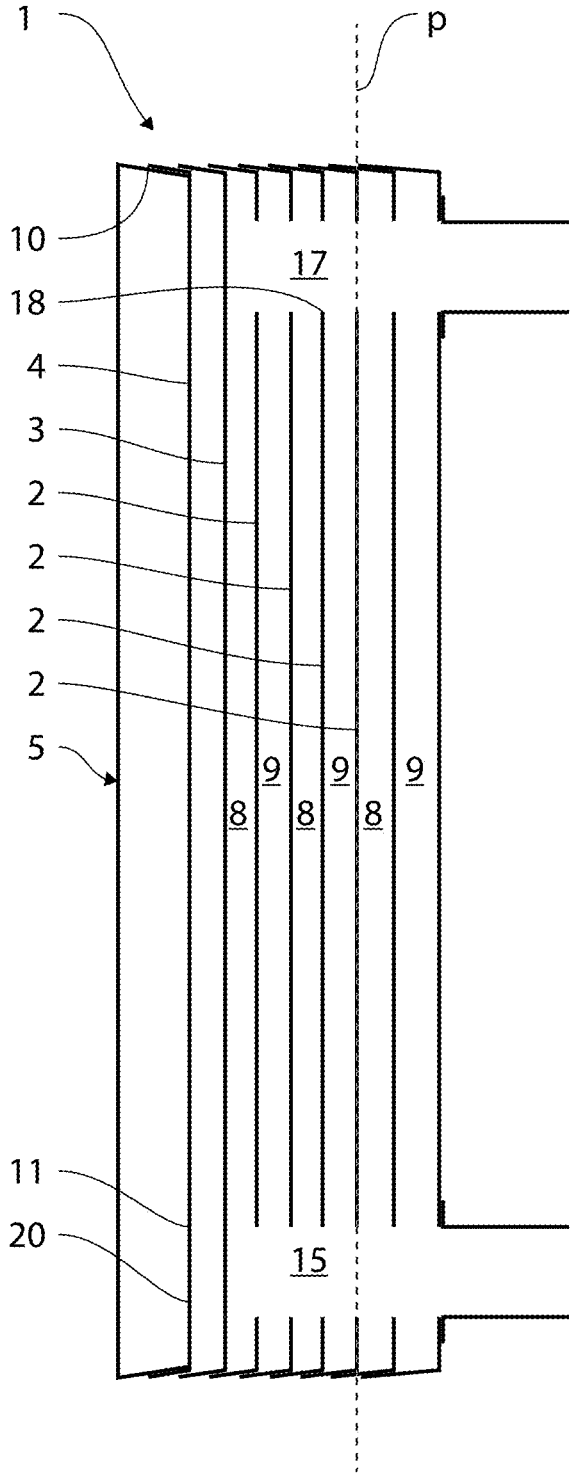
FIG. 2 discloses schematically a longitudinal sectional view along the line II-II in FIG. 1.

FIGS. 1 and 2 disclose a plate heat exchanger 1. The plate heat exchanger 1 comprises a plurality of plates 2, 3, 4 arranged beside each other to form a plate package 5 of the plate heat exchanger 1.

The plates 2, 3, 3 of the plate package 5 may be permanently joined to each other, for instance by means of a brazing material and through a brazing process.

Each of the plates 2, 3, 4 extends in parallel with a respective extension plane p.

Figure 3:
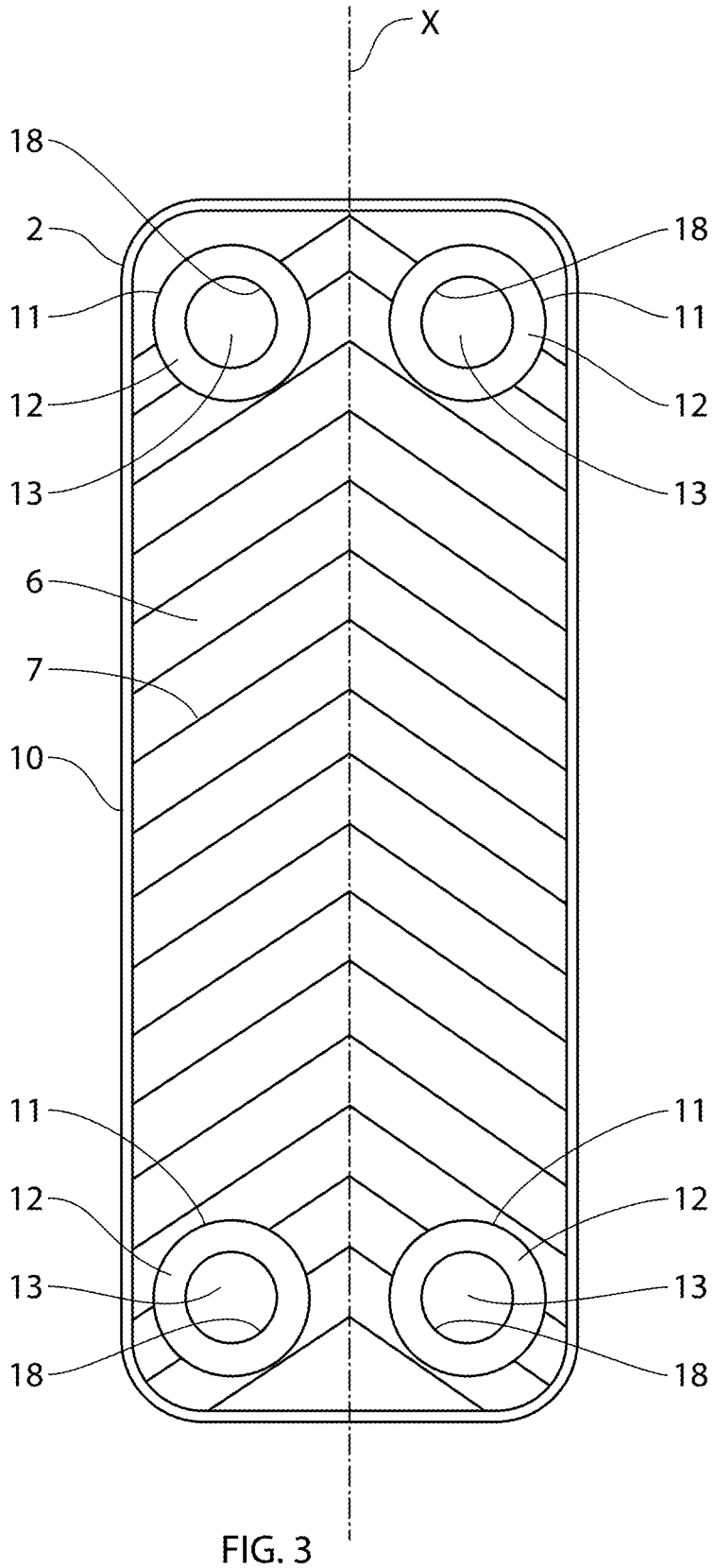
FIG. 3 discloses schematically a plan view of a plate of the plate heat exchanger in FIG. 1.
Figure 4:
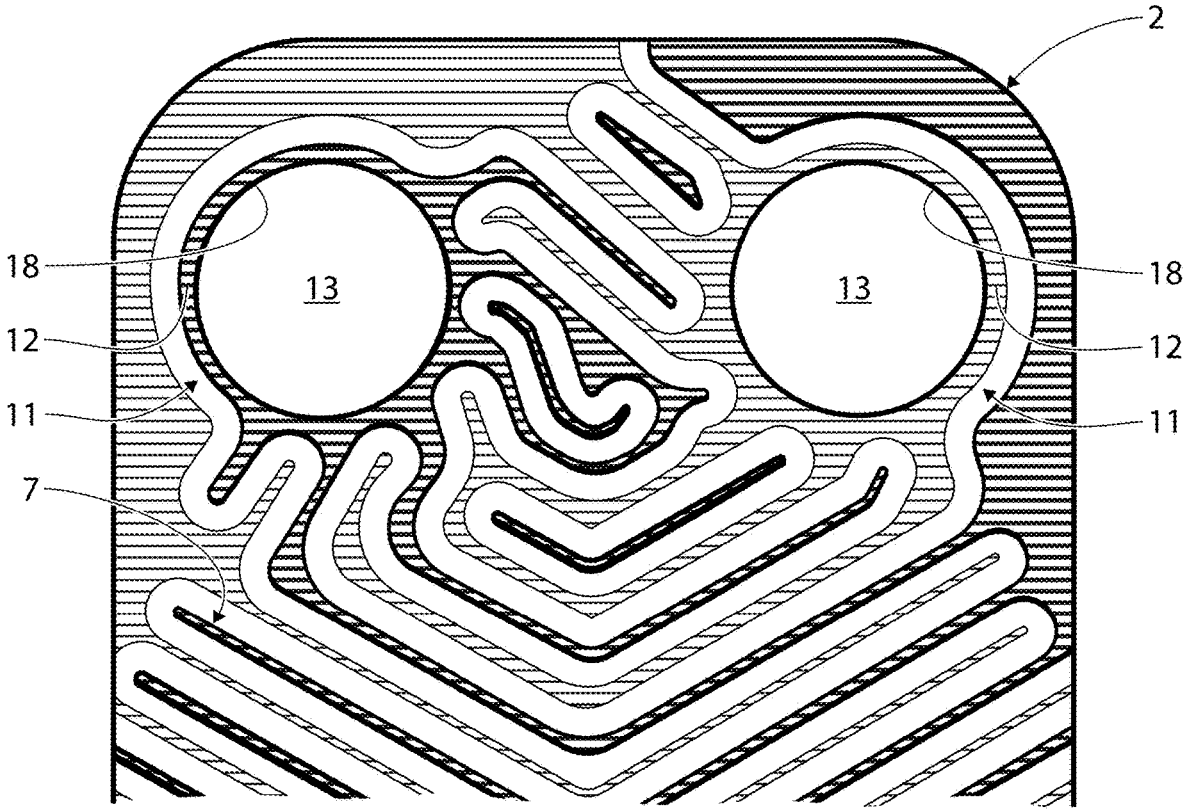
FIG. 4 discloses schematically a plan view of a part of a heat exchanger plate of the plate hear exchanger in FIG. 1.

Each of the plates 2, 3, 4, see FIG. 3, comprises a central area 6 extending in parallel with the extension plane p of the plate 2, 3, 4. The central area 6 comprises or consists of a corrugation 7 of ridges and valleys. The corrugation 7 extends between an upper level p' at a distance from the main extension plane p and a lower level p" at a distance from and on an opposite side of the main extension plane p so that the ridges extend to the upper level p' and the valleys to the lower level p".

The plates 2, 3 are stacked onto each other in the plate packages to form first plate interspaces 8 for a first medium and second plate interspaces 9 for a second medium. The first and second plate interspaces 8 and 9 are arranged in an alternating order in the plate package 5, as is illustrated in FIG. 2.

Each of the plates 2, 3, 4 comprises an edge area 10 which extend around and encloses the central area 6. The edge area 10 may adjoin the central area 6. The edge area 10 may consist of or may comprise a flange sloping in relation to the extension plane p, see FIG. 2.

Each of the plates 2, 3, 4 comprises four porthole areas 11 are provided inside the edge area 10, and preferably in a respective corner area of the plate 2, 3, 4, see FIG. 3. The porthole areas 11 may be located on the central area 6.

Each of the porthole areas 11 comprises an annular flat area 12. The annular flat area 12 is located at one of the upper level p' and the lower level p". In the embodiments disclosed, two of the annular flat areas 12 are located at the upper level p' and the two other annular flat areas 12 are located at the lower level p". In the first embodiment, the plates 2, 3, 4 comprise heat exchanger plates 2, a first end plate 3 provided outside and adjoining an outermost one of the heat exchanger plates 2 in the plate package 5, and a second end plate 4 provided outside and adjoining the first end plate 3 in the plate package 5, as can be seen in FIG. 2.

The Heat Exchanger Plates 2

As can be seen in FIG. 3, each of the heat exchanger plates 2 comprises four portholes 13 extending through a respective one of the porthole areas 11. Each of the portholes 13 of the heat exchanger plates 2 is defined by a porthole edge 18 formed by the annular flat area 12.

The portholes 13 of the heat exchanger plates 2 form four porthole channels 14-17, which may form a first inlet porthole 14 for the first medium to the first plate interspaces 8, a first outlet porthole 15 for the first medium from the first plate interspaces 8, a second inlet porthole 16 for the second medium to the second plate interspaces 8, and a second outlet porthole 17 for the second medium from the second plate interspaces 8.

The outermost heat exchanger plate 2 located on the side of the plate package 5 being opposite to the first and second end plates 3, 4 may form an outermost frame plate for attachment of conduits enabling communication with the porthole channels 14-17 for the first and second media.

Each of the heat exchanger plates 2 are identical. When arranging the heat exchanger plates 2 on each other in the plate package 5, every second heat exchanger plate 2 may be rotated 180° in the extension plane p. Consequently, every second heat exchanger plate 2 may have two annular flat areas 12 located at the lower level p" and adjoining a respective annular flat area 12 located at the upper level p' on the adjacent heat exchanger plate 2, provided that there is an adjacent heat exchanger plate 2. Said every second heat exchanger plate 2 also has two annular flat areas 12 located at the upper level p' and adjoining a respective annular flat area 12 on the adjacent heat exchanger plate 2, provided that there is an adjacent heat exchanger plate 2.

The First and Second End Plates 3, 4

Figure 5:
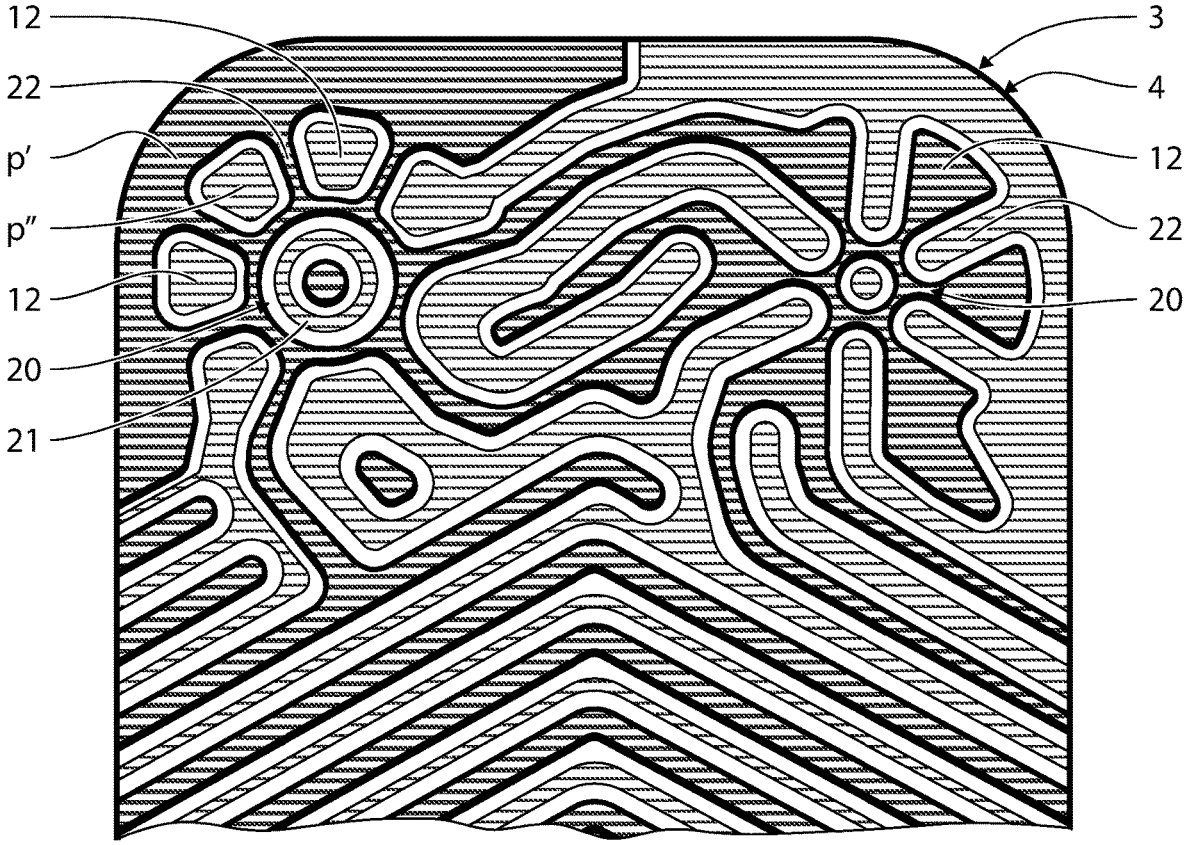
FIG. 5 discloses schematically a plan view of a part of a first or second end plate of the plate hear exchanger in FIG. 1.
Figure 7:
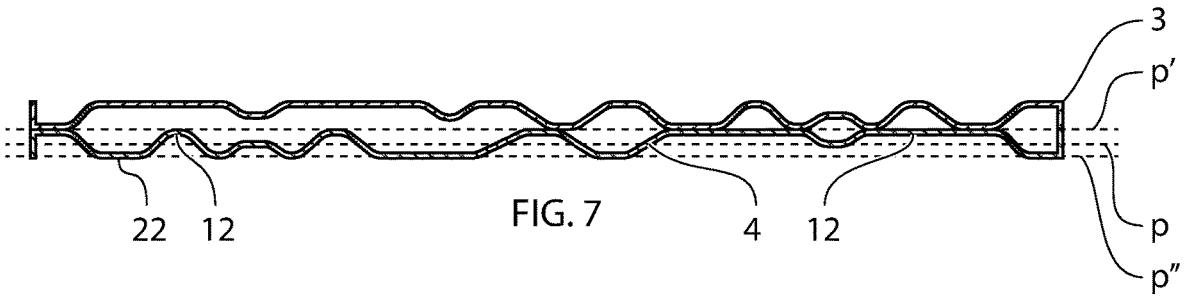
FIG. 7 discloses schematically a sectional view through two of the porthole areas of a first and second end plate in the plate package according to the first embodiment.
Figure 8:
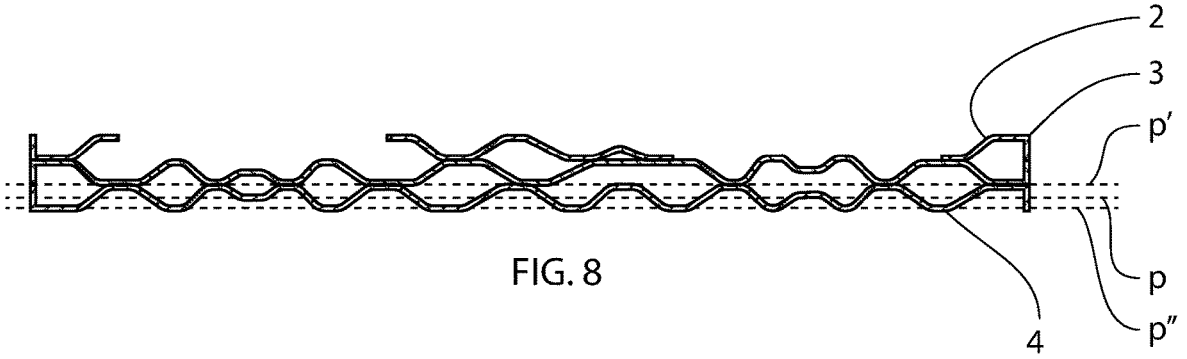
FIG. 8 discloses schematically a sectional view through two of the porthole areas of a first and second end plate in the plate package according to the first embodiment.

The four porthole areas 11 of the first end plate 3 form two annular flat areas 12 located at the upper level p' and adjoining a respective annular flat area 12 located at the lower level p" on the adjacent heat exchanger plate 2, and two annular flat areas 12 located at the lower level p" and adjoining a respective annular flat area 12 located at the upper level p' on the second end plate 4, see FIGS. 5 and 7.

In FIG. 5, one annular flat area 12 at the upper level p' is disclosed to the right and one annular flat area 12 at the lower level p" to the left.

Each of the porthole areas 11 of the first end plate 3 and of the second end plate 4 is closed by means of a plate portion 20 surrounded by the annular flat area 12. The plate portion 20 may be circular, or may at least have a circular outer contour adjoining the annular flat area 12. The plate portion 20 may be a portion of the plate, for instance metal plate, forming the starting plate that is formed to the plates 2, 3, 4 by a pressing operation method. In the heat exchanger plates 2, the plate portions 20 have been removed by means of a cutting operation.

The plate portion 20 may have a strengthening area 21 located at the lower level p" when the annular flat area 12 is located at the upper level p', and at upper level p' when the annular flat area is located at the lower level p". The strengthening area 21 may have a flat extension at the upper level p' and the lower level p", respectively. The strengthening area 21 may be annular.

As may be seen in FIGS. 5 and 7, each of the porthole areas 11 of the first end plate 3 comprises a number of protrusions 22 arranged on and projecting from the annular flat area 12 to one of the lower level p" and the upper level p'. The protrusions 22 may project to the lower level p" when the annular flat area 12 is located at the upper level p', and to upper level p' when the annular flat area 12 is located at the lower level p". Each of the protrusions 22 of the first end plate 3, that project to the upper level p', to the left in FIG. 5, abuts the annular flat area 12 of the adjoining outermost heat exchanger plate 2.

Also, with reference to FIGS. 5 and 7, it may be seen that each of the porthole areas 11 of the second end plate 4 also may comprise a number of protrusions 22 arranged on and projecting from the annular flat area 12 to one of the lower level p" and the upper level p'. Also, with respect to the second end plate 4, the protrusions 22 may project to the lower level p" when the annular flat area 12 is located at the upper level p', and to upper level p' when the annular flat area 12 is located at the lower level p". Each of the protrusions 22 of the second end plate 4, that project to the upper level p', to the left in FIG. 5, may abut a respective one of the protrusions 22 of the annular flat area 12 of the adjoining first end plate 3.

FIGS. 5 and 7 may thus illustrate both first end plate 3 and the second end plate 4. It should be noted that the first end plate 3 and the second end plate 4 are rotated 180° in relation to each other in the extension plane p in the plate package 5.

In the first embodiment, disclosed in FIG. 5, the protrusions 22 extend to the plate portion 20. In particular, the protrusions 22 may extend across the annular flat area 12, and may form beams across the annular flat area 12, for instance along a radial direction with respect to a central point of the porthole area 11. Between the protrusions 22, the annular flat area 12 may adjoin the plate portion 20.

Figure 6:
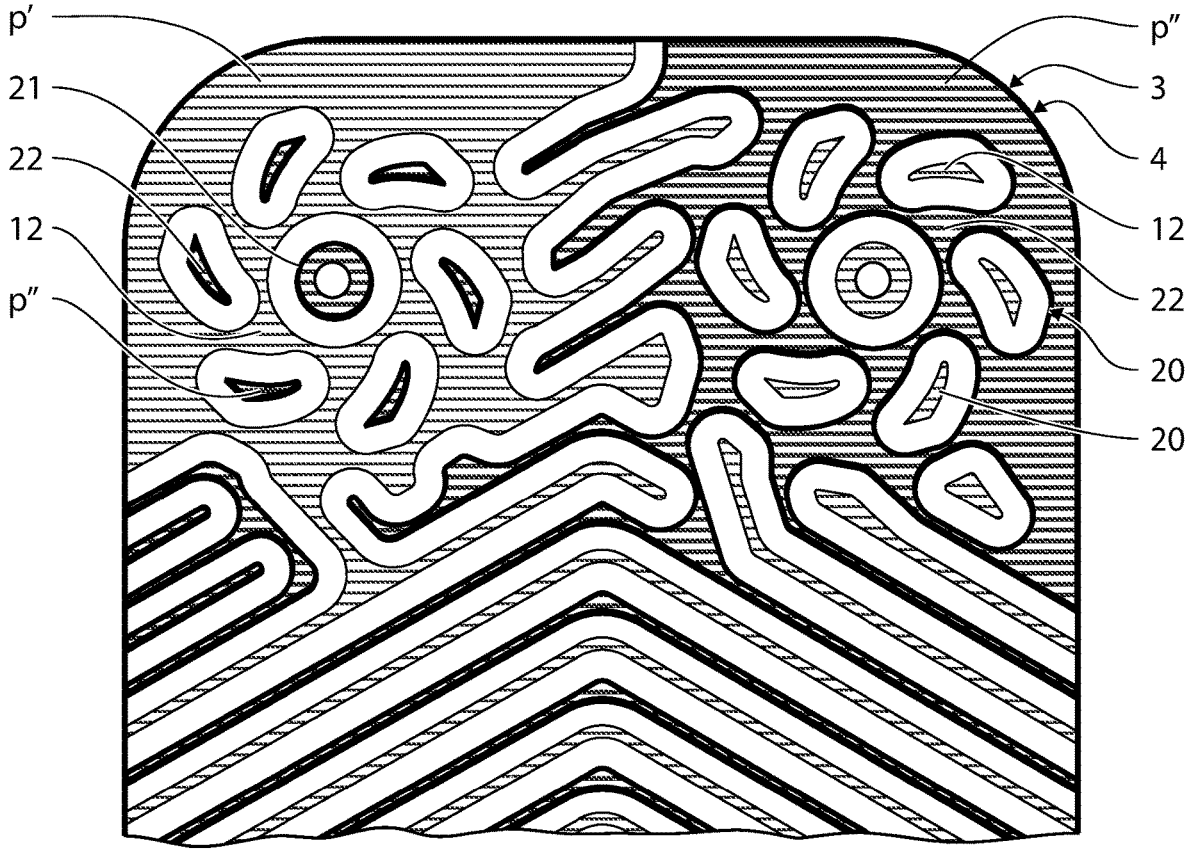
FIG. 6 discloses schematically a plan view of a part of a first or second end plate according to a second embodiment of the plate hear exchanger in FIG. 1.

FIG. 6 refers to a second embodiment of the first end plate 3 and the second end plate 4, which differs from the first embodiment in that the protrusions 22 are located on the annular flat area 12 at a distance from the plate portion 20. In the second embodiment, the protrusions 22 may form isolated protrusions or islands on the annular flat are 12. The annular flat area 12 may thus adjoin the plate portion 20 along the whole circumferential length of the annular flat area, as is illustrated in FIG. 6.

I should be noted that no media may flow through the plate interspace between the first and second end plates 3 and 4, and no media may flow through the plate interspace between the outermost heat exchanger plate 2 and the first end plate 3.

Third Embodiment

A third embodiment of the invention differs from the first and second embodiment in that the second end plate 4 is dispensed with. The plate heat exchanger 1 thus comprises a plate package 5 with the heat exchanger plates 2 and the first end plate 3 forming the outer end plate of the plate package 5. The porthole channels 14-17 are thus closed by a respective plate portion 20 of the first end plate 3. No media may flow through the plate interspace between the first end plate 3 and the outermost heat exchanger plate 2.

Method of Manufacturing

The plate heat exchanger according to the first and second embodiments may be manufactured as explained below.

A plurality of plates 2, 3, 4, such as plane metal plates, are provided. The plurality of plates 2, 3, 4 may be pressed in a first pressing operation to produce a plurality of plates 2, 3, 4, wherein each of the plates 2, 3, 4 comprises a central area 6, an edge area 10 and four porthole areas 11. Through the first pressing operation, the central area 6 may extend in parallel with an extension plane p of the plate 2, 3, 4 and may comprise a corrugation 7 of ridges and valleys. As explained above, the corrugation 7 may extend between an upper level p' at a distance from the main extension plane p and a lower level p" at a distance from and on an opposite side of the main extension plane p so that the ridges extend to the upper level p' and the valleys to the lower level p". Furthermore, the first pressing operation may result in the edge area 10 extending around the central area 6, and each of the four porthole areas 11 comprising an annular flat area 12, which is located at one of the upper level p' and the lower level p". A part of the plate 2, 3, 4 forming an intermediate plate is disclosed in FIG. 9.

The method then comprises following step of selecting a first end plate 3, a second end plate 4 and a number of heat exchanger plates 2 from said plurality of plates 2, 3, 4.

Then four portholes 13 are cut in a following cutting operation through a respective one of the porthole areas 11 of each of the heat exchanger plates 2 obtained through the first pressing operation described above and shown in FIG. 9. The cutting operation may be performed so that each porthole 13 is defined by a porthole edge 18 formed by the annular flat area 12.

Figure 9:
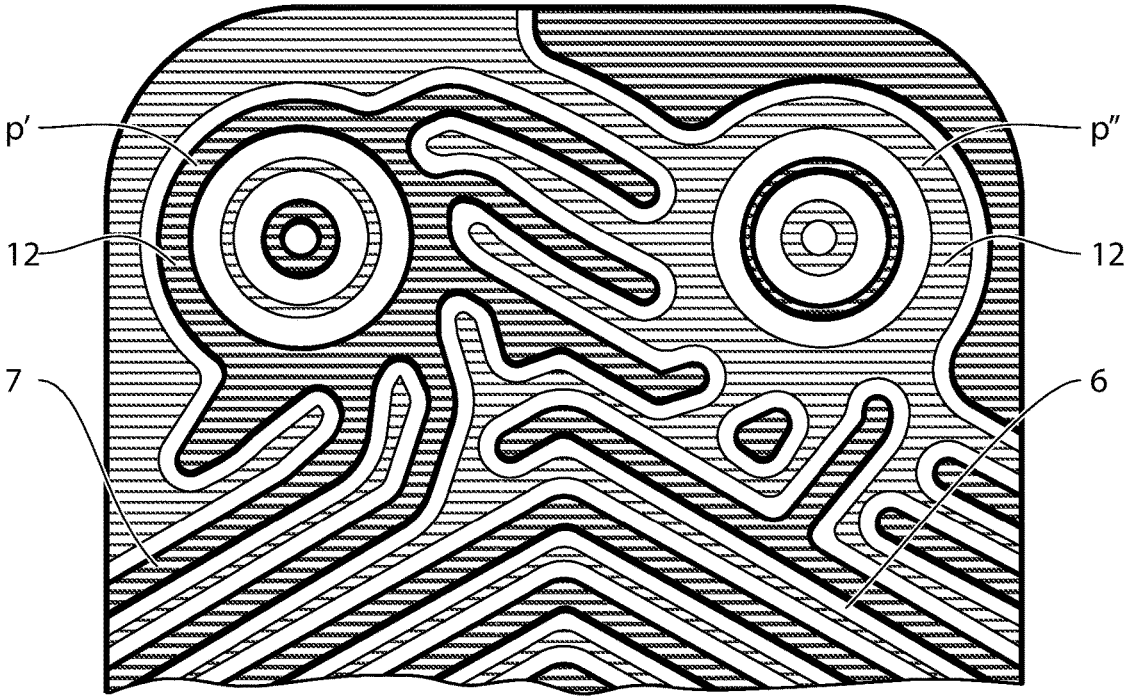
FIG. 9 discloses schematically a plan view of a part of an intermediate plate to be further processed to a heat exchanger plate or a first or second end plate.

In a second pressing operation, the intermediate plate shown in FIG. 9 is pressed to create a number of protrusions 22 to project from the annular flat area 12 to one of the lower level p" and the upper level p' on each of the porthole areas 11 of the first end plate 3.

The method then comprises the step of assembling and joining the heat exchanger plates 2, the first end plate 3 and the second end plate 4 to each other to obtain a plate package 5 having four porthole channels 14-17 extending through the respective portholes 13 of the heat exchanger plates 2 and being closed by the first end plate 3 and the second end plate 4.

In order to manufacture the plate heat exchanger according to the third embodiment, it may be dispensed with the second pressing operation of the second end plate 4, since only the first end plate 3 is included in the plate package 5 of the plate heat exchanger.

The invention is not limited to the embodiments disclosed and described above but may be modified and varied within the scope of the following claims.

The invention claimed is:

1. A plate heat exchanger comprising a plurality of plates arranged beside each other to form a plate package, each plate comprising a central area extending in parallel with an extension plane of the plate and comprising a corrugation of ridges and valleys, wherein the corrugation extends between an upper level at a distance from the main extension plane and a lower level at a distance from and on an opposite side of the main extension plane so that the ridges extend to the upper level and the valleys to the lower level, an edge area extending around the central area, and four porthole areas, each of the four porthole areas comprising an annular flat area, wherein the annular flat area is located at one of the upper level and the lower level, wherein the plates comprise heat exchanger plates and at least a first end plate provided outside and adjoining an outermost one of the heat exchanger plates in the plate package, wherein each of the heat exchanger plates comprises four portholes extending through a respective one of the porthole areas, and wherein each of the porthole areas of the first end plate is closed by means of a plate portion surrounded by the annular flat area, wherein each porthole of the heat exchanger plates is defined by a porthole edge formed by the annular flat area, each of the porthole areas of the first end plate comprises a number of protrusions arranged on and projecting from the annular flat area to one of the lower level and the upper level, and each of the protrusions of the first end plate, that project to the upper level, abuts the annular flat area of the adjoining outermost heat exchanger plate.

2. The plate heat exchanger according to claim 1, wherein the protrusions project to the lower level when the annular flat area is located at the upper level, and to upper level when the annular flat area is located at the lower level.

3. The plate heat exchanger according to claim 1, wherein the plates also comprise a second end plate provided outside and adjoining the first end plate in the plate package so that the first end plate in the plate package is positioned between the outermost heat exchanger plate and the second end plate, wherein each of the porthole areas of the second end plate is closed by a plate portion surrounded by the annular flat area, each of the porthole areas of the second end plate comprises a number of protrusions arranged on and projecting from the annular flat area to one of the lower level and the upper level, and each of the protrusions of the second end plate, that project to the upper level, abuts a respective one of the protrusions of the annular flat area of the adjoining first end plate.

4. The plate heat exchanger according to claim 1, wherein the plate portion, that is surrounded by the annular flat area, is circular and located at the lower level when the annular flat area is located at the upper level, and at upper level when the annular flat area is located at the lower level.

5. The plate heat exchanger according to claim 4, wherein the protrusions extend to the plate portion.

6. The plate heat exchanger according to claim 5, wherein the protrusions extend across the annular flat area.

7. The plate heat exchanger according to claim 4, wherein the protrusions are located on the annular flat area at a distance from the plate portion.

8. The plate heat exchanger according to claim 4, wherein the annular flat area adjoins the plate portion.

9. The plate heat exchanger according to claim 4, wherein the plate portion comprises a strengthening area that has a flat extension at the upper level and the lower level, respectively.

10. The plate heat exchanger according to claim 4, wherein the strengthening area is annular.

11. The plate heat exchanger according to claim 1, wherein the protrusions have a flat extension at the upper level and the lower level, respectively.

12. A plate heat exchanger comprising a plurality of plates arranged beside each other to form a plate package, each plate comprising a central area extending in parallel with an extension plane of the plate and comprising a corrugation of ridges and valleys, wherein the corrugation extends between an upper level at a distance from the main extension plane and a lower level at a distance from and on an opposite side of the main extension plane so that the ridges extend to the upper level and the valleys to the lower level, an edge area extending around the central area, four porthole areas, each of the four porthole areas comprising an annular flat area, wherein the annular flat area is located at one of the upper level and the lower level, the plates comprising at least a first end plate and a plurality of plates that are each provided with four through holes extending through a respective one of the porthole areas, every one of the plates in the plate package that includes four through holes being a heat exchanger plate, the first end plate being provided outside and immediately adjacent an outermost one of the heat exchanger plates in the plate package, each of the porthole areas of the first end plate being closed by a plate portion that is integral with and surrounded by the annular flat area so that the annular flat area is an integral continuation of the plate portion, each porthole of the heat exchanger plates being defined by a porthole edge formed by the annular flat area, each of the porthole areas of the first end plate comprising protrusions arranged on and projecting from the annular flat area to one of the lower level and the upper level, and each of the protrusions of the first end plate, that project to the upper level, abutting the annular flat area of the adjoining outermost heat exchanger plate.

13. The plate heat exchanger according to claim 12, wherein the plates also comprise a second end plate provided outside and immediately adjacent the first end plate in the plate package so that the first end plate in the plate package is positioned between the outermost heat exchanger plate and the second end plate, each of the porthole areas of the second end plate being closed by a plate portion that is integral with and surrounded by the annular flat area so that the annular flat area is an integral continuation of the plate portion of the second end plate, each of the porthole areas of the second end plate comprising a number of protrusions arranged on and projecting from the annular flat area of the second end plate to one of the lower level and the upper level of the second end plate, and each of the protrusions of the second end plate, that project to the upper level, abuts a respective one of the protrusions of the annular flat area of the adjoining first end plate.

14. The plate heat exchanger according to claim 12, wherein the protrusions project to the lower level when the annular flat area is located at the upper level, and to upper level when the annular flat area is located at the lower level.

15. The plate heat exchanger according to claim 12, wherein the plate portion, that is surrounded by the annular flat area, is circular and located at the lower level when the annular flat area is located at the upper level, and at upper level when the annular flat area is located at the lower level.

16. The plate heat exchanger according to claim 15, wherein the protrusions extend to the plate portion.

* * * * *